United States Patent [19]

Klimpert et al.

[11] Patent Number: 4,508,521

[45] Date of Patent: Apr. 2, 1985

[54] IMPACT RESPONSIVE TOY

[75] Inventors: Randall J. Klimpert, Chicago; Burton C. Meyer, Downers Grove, both of Ill.

[73] Assignee: Marvin Glass & Associates, Chicago, Ill.

[21] Appl. No.: 435,555

[22] Filed: Oct. 21, 1982

[51] Int. Cl.[3] ..... A63H 3/12

[52] U.S. Cl. ..... 446/486; 446/4; 446/321

[58] Field of Search ..... 46/201, 221, 222, 212, 46/263, 153, 135 R; 446/4, 321, 486

[56] References Cited

U.S. PATENT DOCUMENTS

| | | | |
|---|---|---|---|
| 52,782 | 2/1866 | Checkeni | 46/153 |
| 1,247,989 | 11/1917 | Mulock | 446/4 |
| 1,555,644 | 9/1925 | Duncan | 46/153 |
| 1,610,724 | 12/1926 | Wilson | 46/153 |
| 1,762,374 | 6/1930 | Yancey | 46/153 |
| 2,344,402 | 3/1944 | Frady | 446/4 |
| 2,457,653 | 12/1948 | Froelich | 446/4 |
| 2,519,298 | 8/1950 | Thorp | 446/4 |
| 2,584,798 | 2/1952 | Goerditz | 46/153 |
| 2,597,094 | 5/1952 | Gutmann | 46/206 |
| 2,633,663 | 4/1953 | Fuerst | 46/153 X |
| 2,662,339 | 12/1953 | Paul | 46/153 |
| 2,757,482 | 8/1956 | Brown et al. | 46/201 |
| 3,032,921 | 5/1962 | Greene | 46/135 R |
| 3,734,500 | 5/1973 | Cooper | 273/380 |
| 3,892,086 | 7/1975 | Gay et al. | 446/486 |
| 3,959,920 | 7/1976 | Ieda | 46/201 |
| 4,030,239 | 6/1977 | White et al. | 46/153 X |

FOREIGN PATENT DOCUMENTS

| | | | |
|---|---|---|---|
| 243752 | 7/1881 | Fed. Rep. of Germany | 46/153 |

*Primary Examiner*—F. Barry Shay

*Attorney, Agent, or Firm*—John S. Pacocha

[57] ABSTRACT

An impact responsive toy has a part of the body that is movable to expose the part in its regular condition or in a damaged condition. A biasing force urges exposure of the hidden damaged condition while the part is releasably latched to expose the undamaged or regular position. Application of an outside force, such as the impact of a crash, releases the latch to automatically and instantaneously switch the undamaged and damaged conditions.

10 Claims, 8 Drawing Figures

IMPACT RESPONSIVE TOY

BACKGROUND OF THE INVENTION

1. Field of the Invention

The invention relates to toys such as vehicles having an action feature responsive to impact.

2. Background Art

There are toys in which a part breaks away or the entire body explodes as a result of the force of a crash on impact. Examples of such break-apart toys are the vehicles shown in U.S. Pat. Nos. 3,959,920; 3,734,500; 3,176,429; 2,757,482; and 2,597,094. While spectacular, such prior art toys do not realistically represent the results of most of the collisions that actually occur involving the real-life vehicles. Moreover, the projecting pieces involved in such assemblies can present hazards and loose pieces tend to become lost.

SUMMARY OF THE INVENTION

The present invention is concerned with providing a toys such as a vehicle that uses a contained part to realistically represent the results of impact. These and other objects and advantages of the invention are achieved by providing a toy body with a movable part that has sections reresenting a segment of the body in both the regular and damaged conditions. The part is biased to a position exposing the damaged condition but is releasably latched in another position exposing the undamaged appearance. Upon an impact exerting a force against the part in a manner that would be normally expected in a similar real-life crash or accident situation the latch is released and the part is instantly moved to exchange the regular appearance with the damaged appearance.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
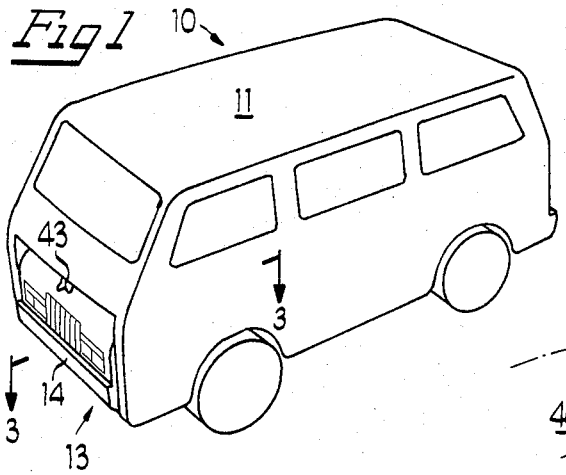
FIG. 1 is a perspective view of a toy vehicle embodying the present invention.

Referring now to the drawings in which like parts are designated by like reference numerals throughout the several views there is shown in FIG. 1 a toy vehicle 10 having a body 11 in which a movable part 13 makes up the front bumper and grill assembly. One section 14 of the part 13 has the normal undamaged bumper and grill assembly while another section 15 has a representation of a damaged or dented bumper and grill.

The part 13 is provided with a central bore 16 and is mounted for revolution about a generally horizontal axis 17 having end stubs 18 and 19. In the position shown in FIGS. 1 and 3–5 the normal section 14 is exposed while the damaged section 15 is hidden by the rest of the body 11. A spring 22 is coiled about the axle 17 with the inside end 23 secured to the stub 18. A slot 24 is provided in the end of stub 18 for insertion and retention of the spring end 23. An axial recess 26 within the part 13 accommodates the spring 22. The other end 27 of the spring is inserted into a slot 28 and secured to part 13.

A frame member 29 for mounting the revolving part 13 is provided for attachment to the vehicle body 11. However, the part 13 may be mounted directly to the body 11 as will be apparent from the following description. A rivet 30 or a similar fastener is used to secure the frame 29 to the body 11. Frame 29 has spaced substantially parallel plates 31 and 32 which abut the inside of the front fender well portions of the body 11. Pin projections 33 are received in mating detents on the body 11 to help secure the frame 29.

Figure 6:
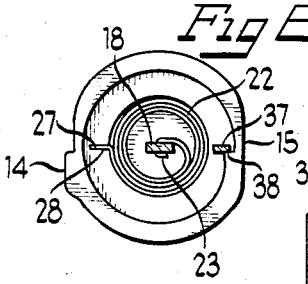
FIG. 6 is an enlarged sectional view taken generally along the line 6—6 of FIG. 3.
Figure 7:
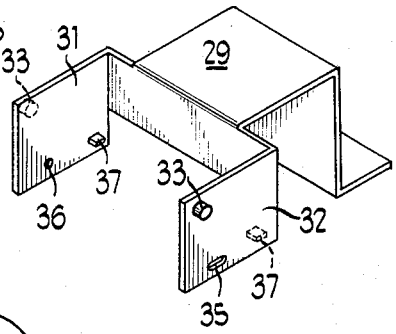
FIG. 7 is an enlarged perspective view of the support frame appearing in FIGS. 3–6.
Figure 8:
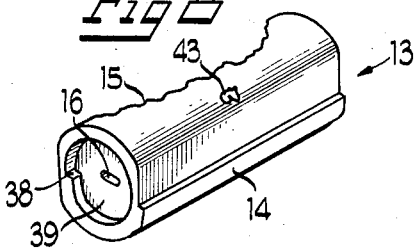
FIG. 8 is an enlarged perspective view of the revolving part appearing in FIGS. 1–4 and 6.

Each of the stub ends 18 and 19 is received in a respective recess 35 and 36 on the frame 29. Alternatively, such recesses could be provided directly in the inside of the fender well portions of the body 11. As shown in FIG. 6, the end 18 is substantially rectangular as is the receiving recess 35 in order to keep the axis 17 from rotating when the part 13 is revolved. In this embodiment the other stub 19 and its receiving recess 36 are not squared off to facilitate proper assembly.

The spring 22 is wound so that when the cylindrical part 13 is inserted with the damaged section of the grill 15 showing, little if any force is exerted by the spring 22. However, when the part 13 is rotated clockwise to expose the undamaged bumper and grill section 14, the coil spring 22 is wound tighter and exerts a biasing force urging the cylinder 13 to revolve counter-clockwise and expose the damaged section.

Figure 2:
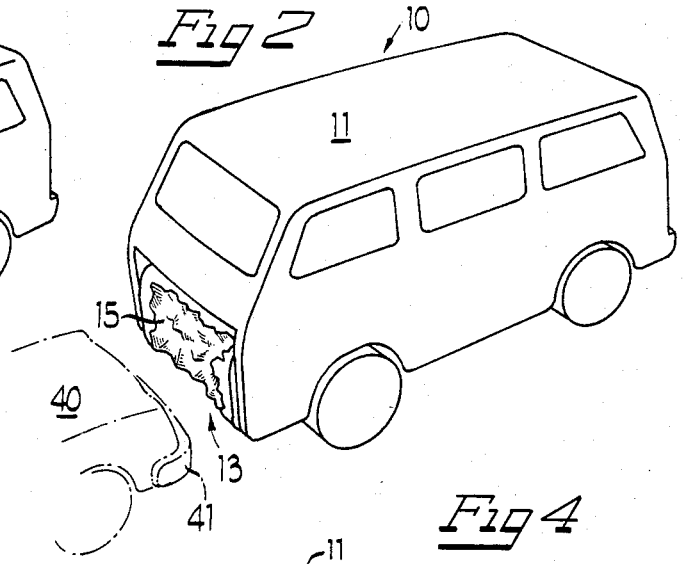
FIG. 2 is another perspective view of the toy vehicle following impact.
Figure 3:
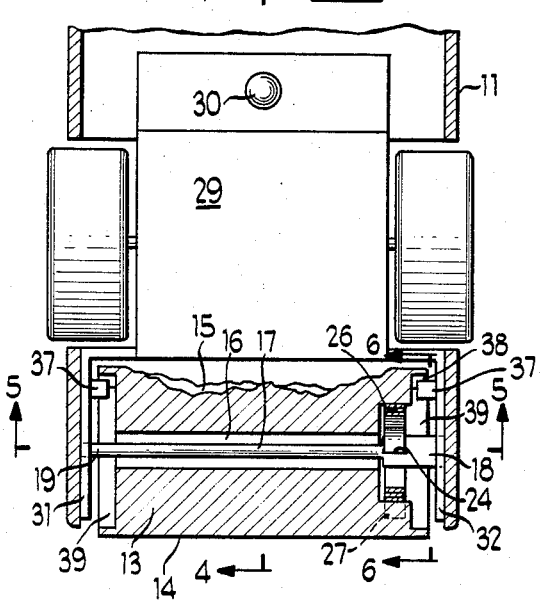
FIG. 3 is an enlarged partial sectional view taken generally along the line 3—3 of FIG. 1.
Figure 4:
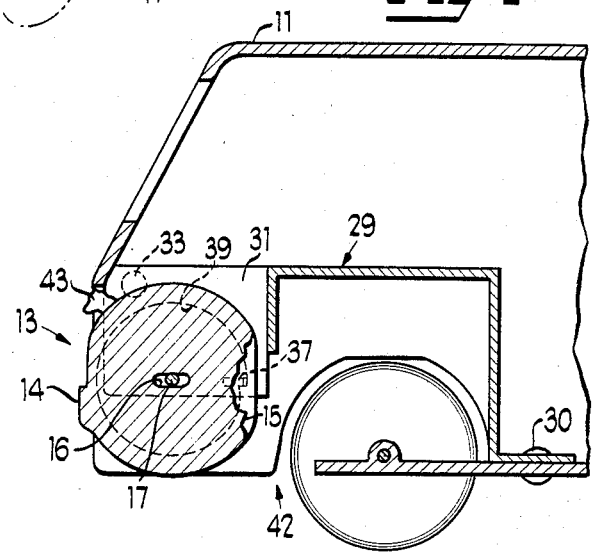
FIG. 4 is an enlarged partial sectional view taken generally along the line 4—4 of FIG. 3.
Figure 5:
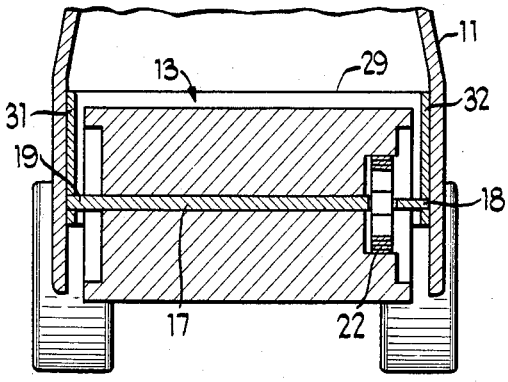
FIG. 5 is an enlarged partial sectional view taken generally along the line 5—5 of FIG. 3.

In order to releasably cock the cylinder 13 in the position exposing the undamaged bumper and grill, a releasable latch or trigger mechanism is provided comprising fixed tabs 37 projecting from the inside of each of the plates 31 and 32. Alternatively, similar tabs could be provided on the body 11 itself. The tabs 37 cooperate with detents or abutments 38 formed in the walls of outer axial recesses 39 in the part 13. As the part 13 is rotated clockwise, the abutments 38 are rotated into alignment with the tabs 37. A trigger mechanism could also be provided wherein projections on the part 13 cooperate with detents in the frame 29 or the vehicle body 11. As shown in FIGS. 3, 4 and 6 the bore 16 is elliptical or elongated in a plane parallel to that in which a major component of force would be expected to be exerted on the bumper and grill assembly in a crash involving that portion of the vehicle. In order to engage or cock the trigger mechanism the part 13 is moved linearly perpendicular to the axis 17 in the opposite direction to that of the major force component. When the vehicle 10 is impacted against a stationary or oncoming object 40 as indicated in FIG. 2, the part 13 is moved back in a direction perpendicular to the axis 17 such that the abutments 38 are moved out of engagement with the tabs 37. Coil spring 22 then urges the part 13 to revolve counter-clockwise exposing the damaged or dented front bumper and grill side 15 and obscuring the normal section 14 as illustrated in FIG. 2.

If, as shown in FIG. 2, the impacted object 40 has any lower projecting step portion like front bumper 41, an additional advantage is obtained from the counter-clockwise revolution of part 13 following impact. As part 13 revolves, the uneven surfaces will grip and climb over the step 41 resulting in the vehicle 10 resting on top of the other vehicle or object with which it has crashed further portraying the effects of a crash or accident.

It will be appreciated that the counter-clockwise revolution resulting from the spring biasing force is very fast, causing virtually instantaneous automatic exposure of the dented segment of the vehicle upon impact. In order to avoid the possibility that part of a child's body could be pinched by that rapid revolution of the part 13, it is desirable that the part rotate towards an open or unencumbered portion of the body of the vehicle such as the area 42 indicated in FIG. 4. This opening should be large enough to accommodate a child's finger which also permits pushing the part 13 forward to cock the trigger mechanism.

To facilitate the cocking or triggering of the revolving part it has been found desirable to provide a stop 43 so that the child can better appreciate when the part 13 has been rotated to a position where it can be moved forwardly to engage the abutments 38 with the tabs 37. Such a stop may be provided by means of a simulated radiator cap, manufacturer's emblem, hood ornament, or other projecting piece that will contact or abut a fixed part of the toy vehicle such as the hood to restrain further revolution of the part 13 beyond the point at which it is in position to be cocked or triggered by forward linear movement.

The vehicle 10 can be provided with other movable parts or other segments of the body such as the roof, sides, and rear bumper. Where the size and styling of the toy body permits, more of such damagable segments can be included.

While there have been illustrated and described particular embodiments of the present invention with respect to a toy vehicle, it will be apparent to those skilled in the art that various changes and modifications may be made without departing from the invention. It is intended in the appended claims to cover all such changes and modifications as fall within the true spirit and scope of the present invention.

What is claimed as new and desired to be secured by Letters Patent is:

1. An impact responsive toy comprising:
an incomplete body member;
a part mounted on the body member;
the part having a periphery divided into a number of sections;
each of the sections having a different appearance;
means mounting the part for movement relative to the body member and to selectively expose to view and accessibility one of the sections to complete the body member while obscuring each section other than the one section;
means moving the part in response to impact upon the part itself to obscure the one section and expose a previously obscured section to change the appearance of the body member without removing the part from the body member;
the part having opposed axle ends and revolving around the axis extending between the axle ends;
the mounting means providing for linear movement of at least one of the axle ends relative to the mounting means in a direction transverse to the axis of revolution in response to impact upon the exposed section;
biasing means urging revolution of the part;
releasable latch means restraining revolution of the part; and
impact upon the exposed section moving the part transverse to the axis of revolution effecting release of the latch means.

2. An impact responsive toy comprising:
a principal body member;
a part mounted on and forming a segment of the principal body member;
means including opposed axle ends mounting the part for movement relative to the body member including at least partial revolution about an axis extending between said axle ends and limited linear movement generally transverse to the axis while otherwise containing the part against removal from the body member;
the part having a periphery divided into a number of sections each having a different appearance;
the principal body member obscuring each section other than one and exposing the one section to view and accessibility;
means biasing the part for revolution about said axis;
latch means restraining the part from revolution; and
the latch means being releasable in response to impact upon the exposed section of the part in a direction transverse to the axis of revolution causing the part to move linearly relative to the mounting means and revolve to expose a previously obscured section and obscure the one section.

3. The toy of claim 1 in which the releasable latch means comprises a projection carried by the body member and engageable with a detent on the part.

4. The toy of claim 1 in which the releasable latch means comprises a tab carried by the body member and an abutment carried by the part that is engageable with the tab.

5. The toy of claim 1 in which stop means are provided to prevent complete revolution of the part.

6. The toy of claim 5 in which the stop means comprises a projection on the part that contacts a portion of the body member.

7. The toy of claim 2 in which the releasable latch means comprises a projection carried by the body member and engageable with a detent on the part.

8. The toy of claim 2 in which the releasable latch means comprises a tab carried by the body member and an abutment carried by the part that is engageable with the tab.

9. The toy of claim 2 in which stop means are provided to prevent complete revolution of the part.

10. The toy of claim 9 in which the stop means comprises a projection on the part that contacts a portion of the body member.

* * * * *